US007553517B1

(12) United States Patent
Jablonski et al.

(10) Patent No.: US 7,553,517 B1
(45) Date of Patent: Jun. 30, 2009

(54) METHOD OF APPLYING A CERIUM DIFFUSION COATING TO A METALLIC ALLOY

(75) Inventors: Paul D. Jablonski, Salem, OR (US); David E. Alman, Benton, OR (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 321 days.

(21) Appl. No.: 11/226,283

(22) Filed: Sep. 15, 2005

(51) Int. Cl.
*C23C 16/06* (2006.01)

(52) U.S. Cl. ..... 427/252

(58) Field of Classification Search ... 427/376.3–376.8, 427/252

See application file for complete search history.

(56) References Cited

U.S. PATENT DOCUMENTS 3,540,878 A 11/1970 Levine et al.
3,667,985 A 6/1972 Levine et al.
4,297,246 A 10/1981 Cairns et al.
5,071,678 A * 12/1991 Grybowski et al. ..... 427/253
5,900,102 A 5/1999 Reeves
6,673,387 B1 1/2004 Zhang et al.
2005/0095358 A1 * 5/2005 Park et al. ..... 427/140
2006/0127695 A1 * 6/2006 Gleeson et al. ..... 428/670

OTHER PUBLICATIONS

Zhang et al, Effects of cerium on dry sand erosion and corrosive erosion of aluminide coating on 1030 steel, Journal of Materials Science Letters 19 (2000), p. 429-432.*
Seal et al, Improvement in the Oxidation Behavior of Austenitic Stainless Steels by Superficially Applied, Cerium Oxide Coatings, Oxidation of Metals, vol. 41, Nos. 1/2, 1994, p. 139-178.*
Metall Publications.
KST Publication.

* cited by examiner

*Primary Examiner*—Timothy H Meeks
*Assistant Examiner*—Elizabeth Burkhart
(74) *Attorney, Agent, or Firm*—James B. Potts; Brian J. Lally; Paul A. Gottlieb

(57) ABSTRACT

A method of applying a cerium diffusion coating to a preferred nickel base alloy substrate has been discovered. A cerium oxide paste containing a halide activator is applied to the polished substrate and then dried. The workpiece is heated in a non-oxidizing atmosphere to diffuse cerium into the substrate. After cooling, any remaining cerium oxide is removed. The resulting cerium diffusion coating on the nickel base substrate demonstrates improved resistance to oxidation. Cerium coated alloys are particularly useful as components in a solid oxide fuel cell (SOFC).

18 Claims, 7 Drawing Sheets a plot of weight gain versus time data for stainless steel test coupons of Example 1.

is a plot of weight gain versus time data for stainless steel test coupons of Example 1.

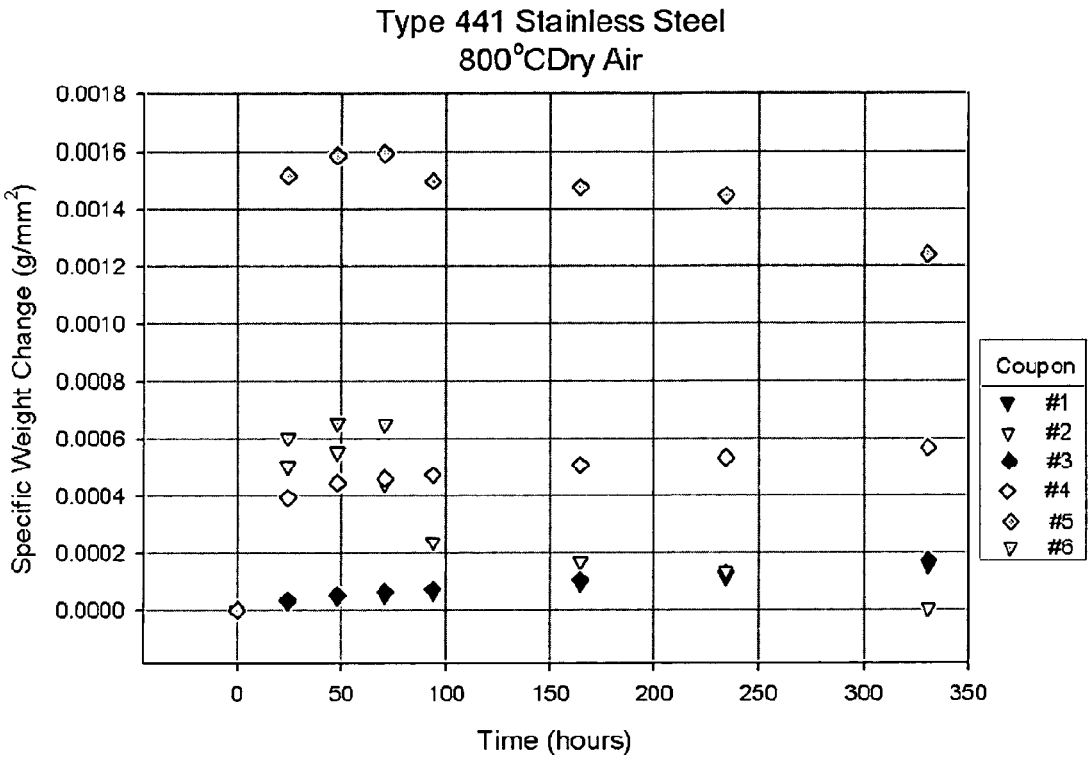
Figure 1a is a plot of weight gain versus time data for stainless steel test coupons of Example 1.

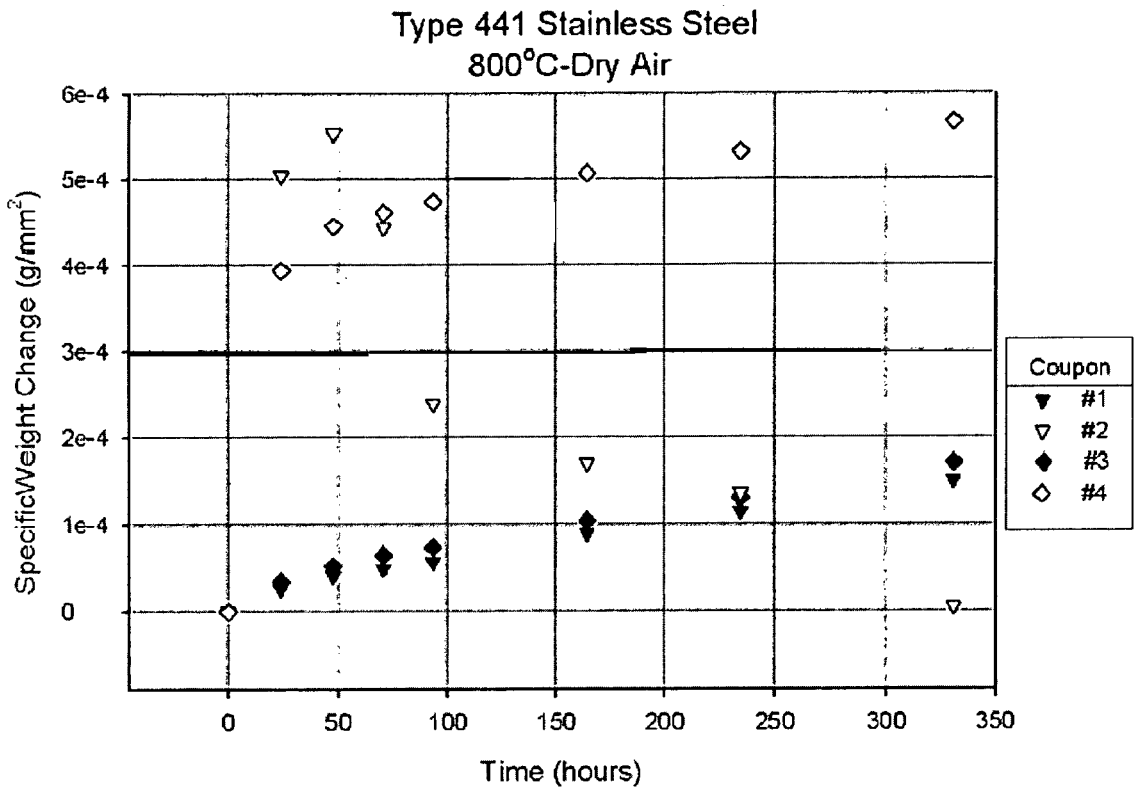
Figure 1b is a plot of weight gain versus time data for stainless steel test coupons of Example 1.

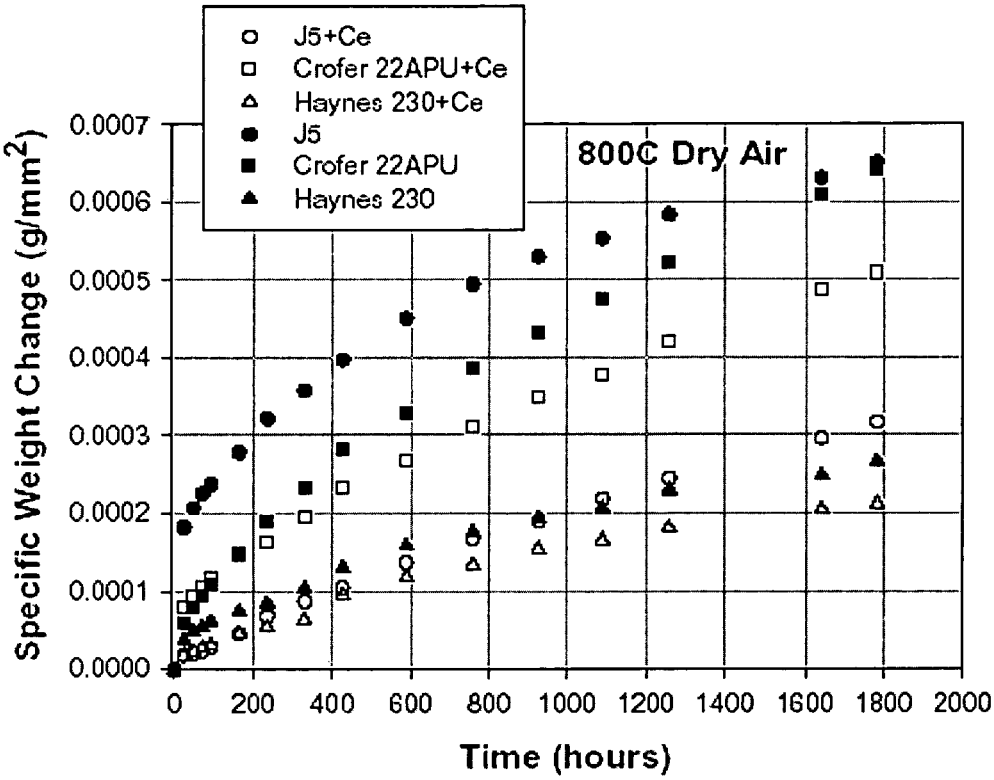
Figure 2 is a plot of weight gain versus time data for test coupons of Example 2.

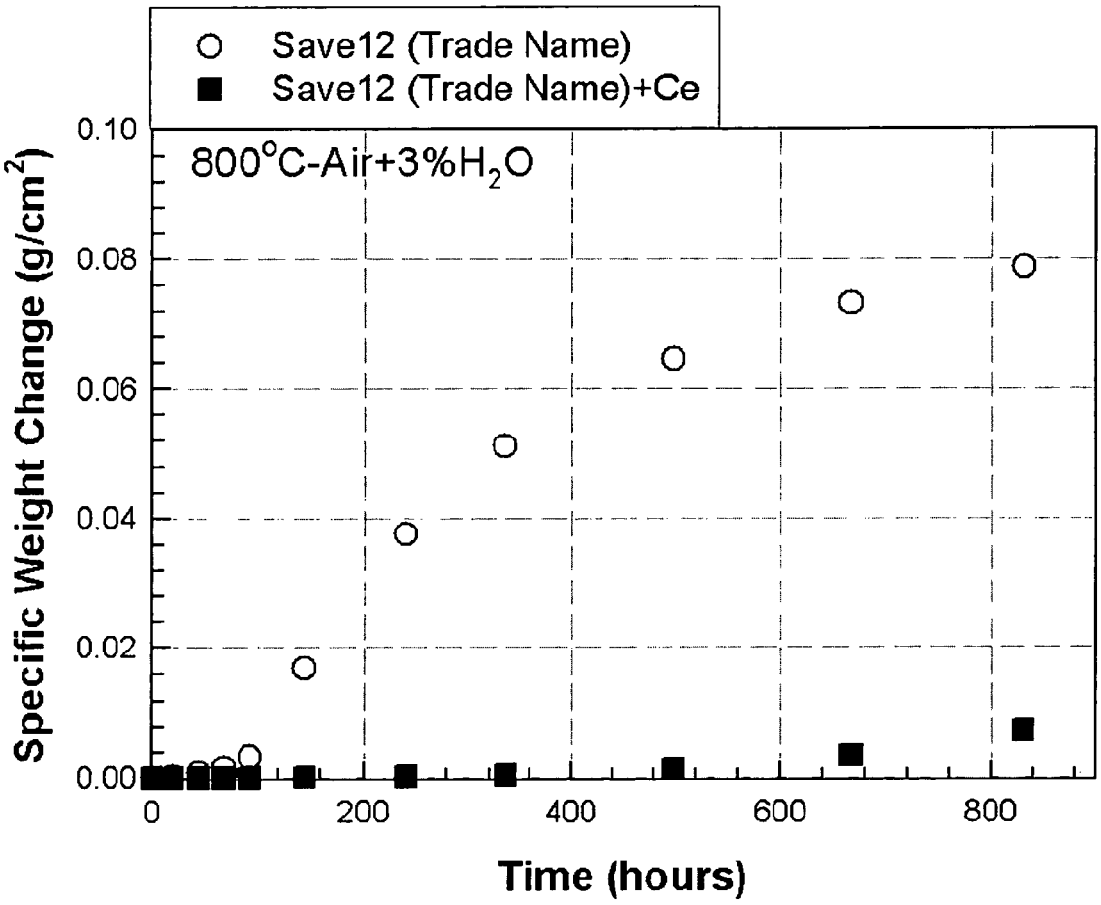
Figure 3 is a plot of weight gain versus time data for test coupons of Example 3.

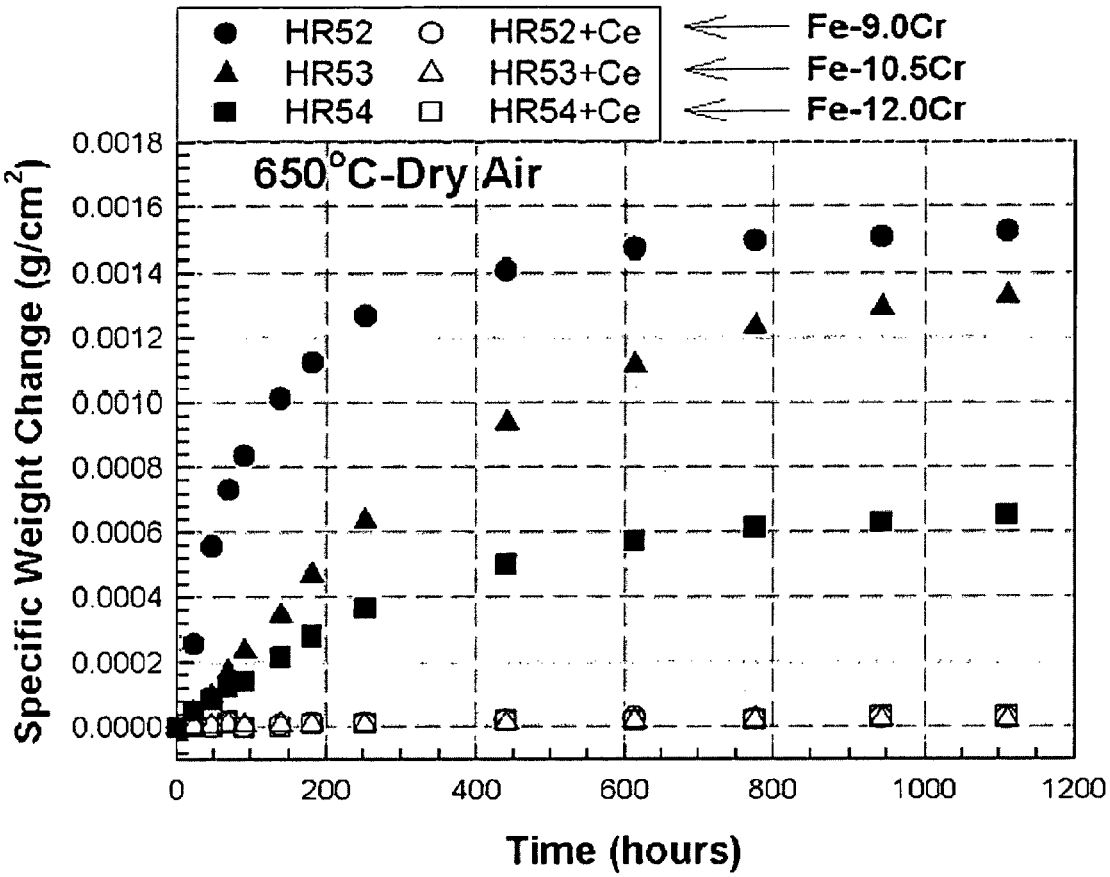
Figure 4 is a plot of weight gain versus time data for test coupons of Example 4.

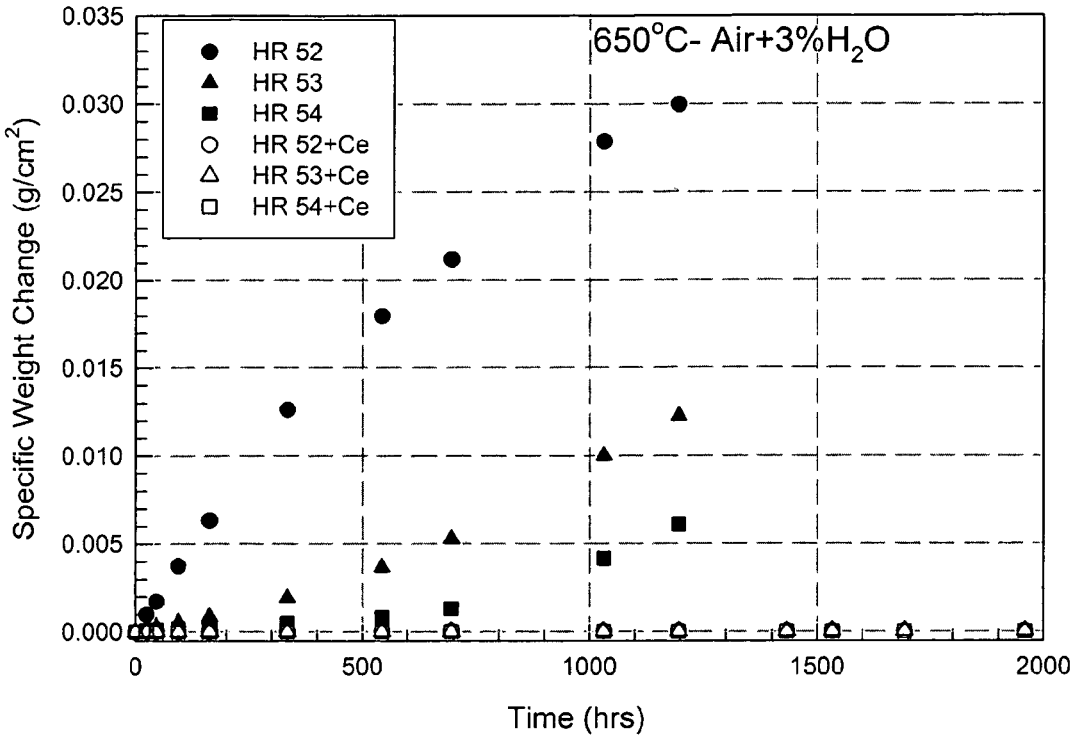
Figure 5 is a plot of weight gain versus time data for test coupons of Example 5.

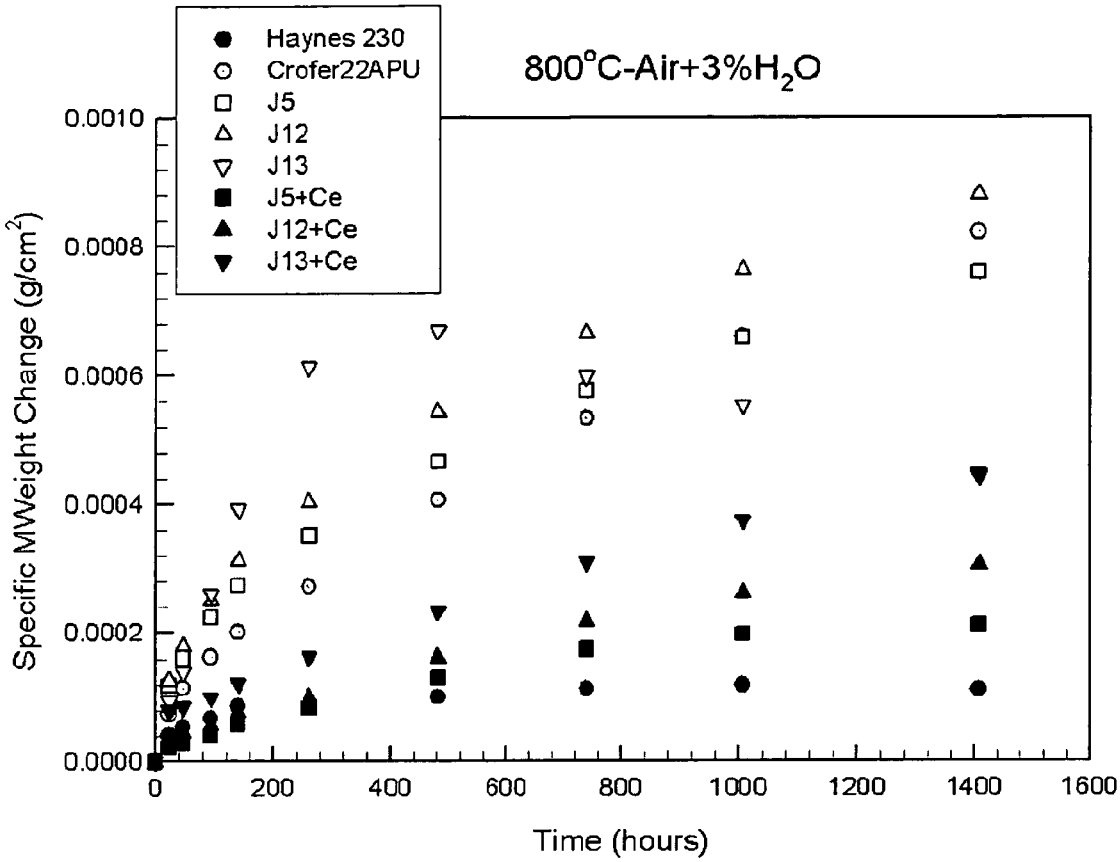
Figure 6 is a plot of weight gain versus time data for test coupons of Example 6.

METHOD OF APPLYING A CERIUM DIFFUSION COATING TO A METALLIC ALLOY

STATEMENT REGARDING FEDERALLY SPONSORED RESEARCH

The invention may be made, used and licensed by or for the United States Government for governmental purposes without the payment of a royalty.

CROSS-REFERENCE TO RELATED APPLICATION

The application is related to applicants' application titled: Nickel-Base Alloy, application Ser. No. 11/226,282, filed on Sep. 15, 2005 and incorporated herein by reference.

BACKGROUND OF THE INVENTION

1. Field of the Invention

The invention relates to a coating process. More particularly, the invention relates to a method of applying a metallic coating by decomposing a metallic compound. Most particularly the invention relates to a method of applying a diffusion coating by applying a metallic compound and a halide activator. The invention also relates to a cerium coated nickel-base or iron-base alloy article.

2. Discussion of the Related Art

Chemical vapor deposition is known for use in coating a metal substrate. Pack cementation process is one technique for carrying out chemical vapor deposition. In general, a coating powder is applied to the substrate to form the cementation pack. The coating powder comprises a coating metal oxide powder, halide salt and optionally powder filler. The cementation pack is heated under inert or reducing atmosphere to an effective temperature to form a diffusion coating. At the effective temperature the halide salt reacts with the metal powder to form metal halide vapors. The metal halide vapors diffuse into the substrate. The metal halide decomposes on contact with the metal substrate, to form the solid state diffusion coating.

There remains in the art an unfulfilled need for a process to form a diffusion coating of cerium on a metal surface.

SUMMARY OF THE INVENTION

A method is disclosed for applying a cerium diffusion coating on a metal alloy substrate. A cerium oxide paste containing a halide activator is applied to a metal alloy substrate. The workpiece is dried and then heated at a temperature of about 500° C. to about 1300° C. in a non-oxidizing atmosphere, for a period of time sufficient to diffuse cerium into the substrate. The workpiece is allowed to cool and any remaining cerium oxide paste is removed. The result is a cerium diffusion coating on the metal alloy substrate.

Cerium diffusion coated alloys are distinguished by improved resistance to oxidation. Cerium coated stainless steel plates have utility as current collector plates in solid oxide fuel cells (SOFC). Cerium oxide coated workpieces also have utility in applications in which oxidation resistance is required.

Other features and advantages of the invention will be set forth in, or apparent from, the following detailed description of the preferred embodiments of the invention.

BRIEF DESCRIPTION OF THE DRAWINGS

FIG. 1*a* is a plot of weight gain versus time data for stainless steel test coupons of Example 1.

FIG. 1*b* is a plot of weight gain versus time data for stainless steel test coupons of Example 1.

FIG. 2 is a plot of weight gain versus time data for test coupons of Example 2.

FIG. 3 is a plot of weight gain versus time data for test coupons of Example 3.

FIG. 4 is a plot of weight gain versus time data for test coupons of Example 4.

FIG. 5 is a plot of weight gain versus time data for test coupons of Example 5.

FIG. 6 is a plot of weight gain versus time data for test coupons of Example 6.

DETAILED DESCRIPTION OF THE INVENTION

The invention is an improvement in a diffusion coating process by the technique referred to as pack cementation. A coating composition is first applied to the surface of a metal alloy substrate. The coating composition contains powdered cerium oxide, a halide activator and optionally inert filler. After application, the coating is dried to remove water, alcohol or other transport fluid. It is then heated in a closed vessel in a non-oxidizing atmosphere. The heating is at a sufficiently high reaction temperature and duration to produce the desired thickness of the diffusion coating on the substrate. The heating may last for a number of hours, or even days at temperatures in excess of 750° F., for example, as high as 2000° F. to 2400° F.

The temperature is adjusted by routine optimization techniques for the thickness of the coating applied and to accommodate the composition of the metal alloy substrate. In particular, higher temperatures are avoided that would adversely affect the hardness of the metal alloy, alter its physical properties or otherwise render it less suitable for use.

One preferred group of metal alloy substrates is selected from among the stainless steels. Stainless steels are divided into four classes: austenitic, ferritic, precipitation-hardenable and martensitic stainless steel. The four classes are defined by the solid phases. Stainless steel substrates useful in the invention include austenitic, ferritic, precipitation-hardenable and martensitic stainless steels.

Many stainless steels useful for the alloy substrate of the invention are available commercially. Illustrative examples include those disclosed in TABLE 1.

TABLE 1

Steel Alloy

| Alloy | Balance of Composition | Nominal Composition, weight % |
|---|---|---|
| SAVE 12 trade name of Sumitomo Corp., Japan | Fe | 0.5 Ni, 9.5 Cr, 3 W, 3 Co, 0.5 Mn |
| HR 52 trade name | Fe | 1.0 Ni, 9.0 Cr, 3 Co, 3 Cu, 0.7 Mo, 0.5 Ti |
| HR 53 trade name | Fe | 1.0 Ni, 10.5 Cr, 4 Co, 3 Cu, 0.7 Mo, 0.5 Ti |
| HR 54 trade name | Fe | 1.0 Ni, 12 Cr, 4 Co, 3 Cu, 0.7 Mo, 0.5 Ti |
| Type 430 Stainless Steel | Fe | 18 Cr, 1 Mn, 1 Si |
| Type 441 | Fe | 18 Cr, |

TABLE 1-continued

| Steel Alloy | | |
|---|---|---|
| Alloy | Balance of Composition | Nominal Composition, weight % |
| Stainless Steel | | 1 Mn, 1 Si, 0.8 (Ta+Nb) |
| Crofer 22APU trade name of ThyssenKrupp AG, Germany | Fe | 22 Cr, 0.5 Mn, 0.08 Ti, 0.06 La |

In a preferred embodiment, the metal alloy substrate is a steel alloy comprising a major proportion of iron, 4 to 30 wt % chromium, 0 to 37 wt % nickel, 0 to 3 wt % silicon, 0 to 15:5 wt % manganese, 0 to 1.2 wt % carbon, 0 to 5 wt % of a metallic element elected from the group consisting of molybdenum, titanium, copper, aluminum, and niobium, and 0 to 1 wt % of a metallic element selected from the group consisting of yttrium and a rare earth element.

In another preferred embodiment, the metal alloy substrate is a nickel-base alloy. Many nickel-base alloys useful for the alloy substrate of the invention are commercially available. Highly alloyed nickel-base alloys are referred to in the art as superalloys. Illustrative examples of nickel-base alloys include those disclosed in TABLE 2.

TABLE 2

| Nickel Alloy | | |
|---|---|---|
| Alloy | Balance of Composition | Nominal Composition, weight % |
| Alloy J1 Mitsubishi Alloy LTES 700 | Ni | 12 Cr, 18 Mo, 1.1 Ti, 0.9 Al |
| Alloy J2 | Ni | 10 Cr, 22.5 Mo, 3 Ti, 0.1 Al, 0.5 Mn, 0.1 Y |
| Alloy J3 | Ni | 12.5 Cr, 22.5 Mo, 3 Ti, 0.1 Al, 0.5 Mn, 0.1 Y |
| Alloy J4 | Ni | 15 Cr, 22.5 Mo, 3 Ti, 0.1 Al, 0.5 Mn, 0.1 Y |
| Alloy J5 | Ni | 12.5 Cr, 22.5 Mo, 1 Ti, 0.11 Al, 0.5 Mn, 0.04 Y |
| Alloy J6 | Ni | 12.5 Cr, 27.7 Mo, 0.5 Mn, 0.1 Y |
| Alloy J7 | Ni | 22 Cr, 27.7 Mo, 0.5 Mn, 0.1 Y |
| Alloy JW9 | Ni | 12.5 Cr, 10 Mo, 17 W, 1.1 Ti, 0.9 Al, 0.5 Mn |
| Alloy J12 | Ni | 10 Cr, 20 Mo, 1 Ti, 0.11 Al, 0.5 Mn, 0.1 Y |
| Alloy J13 | Ni | 8 Cr, 18 Mo, 1 Ti, 0.1 Al, 0.5 Mn, 0.1 Y |
| Haynes ® 230 ™ | Ni | 22 Cr, 2 Mo, 14 W, 0.5 Mn, 3 Fe, 5 Co, 0.3 Al, 0.02 La |
| Haynes ® 242 ™ | Ni | 8 Cr, 25 Mo, 2.5 Co, 2 Fe, 0.8 Mn, 0.8 Si, 0.5 Al, 0.5 Cu, 0.03 C, 0.006 B |

In another preferred embodiment, the metal alloy substrate is a preferred nickel-base alloy. The preferred nickel-base alloy has the following composition:

a major proportion of nickel, and 7 to 32 wt % chromium, 0 to 27 wt % molybdenum, 0 to 5 wt % titanium, 0 to 5 wt % aluminum, 0 to 3 wt % manganese, and 0 to 1 wt % of a metallic element selected from the group consisting of yttrium and a rare earth element.

A particularly preferred nickel-base alloy has been discovered and is referred to herein as J5. This nickel-base alloy has the following composition:

a major proportion of nickel and 10 to 15 wt % chromium, 20 to 25 wt % molybdenum, 0.2 to 2 wt % titanium, 0.005 to 0.5 wt % aluminum, 0.1 to 1 wt % manganese, and 0.01 to 0.5 wt % yttrium.

Alloys J2 through J13 disclosed in Table 2 were the product of research to develop a nickel base superalloy with a coefficient of thermal expansion (CTE) comparable to that of ferritic and martensitic alloys. Ferritic and martensitic alloys are used in fossil fueled power plants.

The present alloys J2 through J13 were developed for use as internal components in a Solid Oxide Fuel Cell (SOFC). SOFC components such as interconnectors must be electrically conductive in an operating range of 700° C. to 800° C. In order for this to occur, a protective chromia scale ($Cr_2O_3$) must be formed on the surface of the alloy. Chromia is an intrinsic semiconductor at SOFC operating temperatures. In contrast, $SiO_2$ and $Al_2O_3$ are insulators. A Cr—Mn spinel phase is also formed on the outer surface of the chromia scale to prevent chromia evaporation in the moist, oxygen-rich environment of a SOFC interconnector. Chromia evaporation poisons the SOFC reaction.

In formulating a low coefficient of thermal expansion (CTE) alloy, chromium for oxidation resistance is balanced against molybdenum and/or tungsten for low CTE. Alloying a nickel base with iron, cobalt and chromium increases the CTE. Alloying the same nickel base with molybdenum, tungsten, carbon, aluminum and titanium decreases CTE.

Also, manganese is added to cause formation of an outer Cr—Mn spinel phase during initial oxidation of the workpiece in a moist environment of an SOFC. Yttrium is added to enhance scale stability. Aluminum is reduced to a necessary amount in order to prevent formation of $Al_2O_3$ which is not conductive. Molybdenum and/or tungsten are increased to reduce CTE. Titanium also reduces CTE while increasing strength of the alloy by precipitation of $Ni_3Ti$.

Yamamoto et al. have derived an empirical formula for calculating the CTE of nickel alloys in the temperature range of 25° C. to 700° C. R. Yamamoto, et al., Materials for Advanced Power Engineering-2002, Proc. 7$^{th}$ Leige Conf. Sept. 30-Oct. 3, 2002, *Energy and Technology* Vol. 21, Forschungszentrum Julich GmbH Institut Fuer Werkstoffe und Verfahren der Energietechnik.

$$CTE=13.8732+7.2764\times10^{-2}[Cr]-7.9632\times10^{-2}[W]-8.2385\times10^{2}[Mo]-1.835\times10^{-2}[Al]-1.633\times10^{-1}[Ti].$$

The surface of the alloy substrate should be free of oils and other liquids as well as be scale free before applying the cerium oxide paste. In the laboratory, we polished coupons with 600-grit sandpaper and then rinsed with methyl alcohol. An industrial degreasing would have been sufficient to clean the surface.

The thickness of the cerium diffusion coating can be controlled by varying the diffusion process parameters, time and temperature. Diffusion coatings have been produced as thin as 0.0001 inch (0.1 mils) and as thick as 0.005 inch (5 mils). However these thicknesses are not limiting. The thickness of the diffusion coating is selected based on the protection needed against corrosion resistance and oxidation resistance. A substantially uniform diffusion coating can be produced at any selected thickness over the entire range of about 0.0001 to 0.005 inch. A preferred thickness is in the range of about 0.0002 inch to 0.002 inch.

Cerium oxide is commercially available as either a powder or paste. The cerium oxide has a purity of 99.5 wt % to 99.99 wt %. The metal component has a nominal particle size of 44 microns and a particle size range of about 2 to about 300 microns. The paste includes water or a light hydrocarbon liquid referred to as mineral spirits or alcohol having a specific gravity of 0.7 to 0.8 at 60° F. and a boiling point in the range of 150° F. to about 190° F.

The halide activator may be selected from any of the activators known for use in the pack cementation technique. The halide activator is included in an amount of about 0.1 wt % to about 10 wt %, preferably about 0.5 wt % to about 5 wt %, more preferably about 0.5 wt %. Suitable halide activators may be selected from any of the activators known for this purpose and combinations thereof and equivalents. Useful halide activators include the following examples and equivalents.

Fluoride

Ammonium fluoride

Potassium fluoride

Sodium fluoride

Chloride

Aluminum chloride

Aluminum chloride (hydrated)

Ammonium chloride

Bismuth chloride

Cadmium chloride

Cobalt chloride

Ferric chloride

Nickelous chloride

Sodium chloride

Titanium tetra chloride

Tri chloracetic acid

Tungsten hexa chloride

Tungsten tetra chloride

Iodide

Aluminum iodide

Ammonium iodide

Bismuth tri iodide

Cadmium iodide

Iodine

Lead iodide

Nickel iodide

Titanium tetra iodide

Tungsten tetra iodide

Bromide

Aluminum bromide

Ammonium bromide

Titanium tetra bromide

Tungsten penta bromide

Tungsten tetra bromide

Equivalents

Magnesium oxide

The coating composition may consist entirely of essentially pure particulate cerium oxide with about 0.1 wt % to 10 wt % halide activator, preferably about 0.5 wt %. In the alternative, the coating composition may be a blend of the cerium oxide with inert filler.

The inert filler may comprise 10 wt % to 80 wt % of the coating composition. Fillers are known in the art that inhibit sintering of the cerium oxide. Examples of inert materials include alumina, thoria, calcia, zirconia and other stable and inert refractory oxides and mixtures thereof. Alumina is preferred.

Although any particle size may be employed, it has been found advantageous to use particles of relatively fine size. The size of particles is often expressed as a number which corresponds to the mesh screen size of a sieve during particle classification. The screen size indicates the number of openings in the mesh screen per inch. Typical particle sizes are around 325 mesh and may be as small as 400 mesh. The inert material may have the same particle size range as the cerium oxide. Preferably, both the cerium oxide and the inert material are fine for ease in suspending in a paste or slurry.

Cerium oxide, activator and optionally, filler, are combined, thoroughly mixed as required to make the final coating composition. This is conveniently carried out by first making a powder mixture of 99.5 wt % cerium oxide and 0.5 wt % sodium chloride. Then water is added in an amount of about 30 wt % to 40 wt %. This is stirred until it has a consistence of about milk or cream. Frequent stirring or continuous stirring during application provides the best coating.

The coating composition is applied by any convenient, cost effective manner. Dipping, brushing and spraying are all effective.

One application of the composition is usually sufficient to apply a coating of desired thickness and is therefore preferred. The dry coating is visually inspected. If any bare spots are noticed, the coating is touched up or an entire second coating may be applied.

Drying is optional. In practice more uniform coatings are produced with drying. Drying is cost effective and therefore is recommended. Drying is accomplished by heating the coated workpiece in an oven at 80° C. to 100° C., preferably 90° C. In the alternative, the work piece may be dried in low humidity laboratory or shop air. Care should be taken to avoid blistering or cracking during drying. Following drying, the work piece should be inspected for uniformity of coating and for any imperfections or blemishes. With care and experience a uniform, dried coating is achieved.

Reaction takes place in a closed vessel so that a non-oxidizing atmosphere can be maintained around the work piece. The atmosphere may be vacuum, hydrogen or other non-oxidizing or reducing atmosphere.

The workpiece is allowed to cool to room temperature. Any remaining paste is then removed. This is accomplished by water washing, brushing, scrubbing and the like.

Some alloys require post treatment annealing. For example, alloys that require a faster cooling rate more rapid than is possible in the treatment furnace or alloys that require solution and precipitation heat treatments to fully develop mechanical properties would benefit from post treatment annealing. The improvement in physical properties achievable with a post treatment annealing would be apparent to one skilled in the art. Post treatment annealing will not adversely affect the treated surface.

The mechanism of the invention is not known with mathematical certainty. However, it is thought that the coating of stainless steel with cerium oxide followed by heat treating promotes the formation of a protective and adherent chromium-manganese oxide spinel. This suppresses iron, nickel or other less protective oxides from diffusing into the scale. Incorporation of elements other than chromium and manganese into the scale results in a less protective, less compact and less adherent scale. A significant amount of iron was detected in the oxide scales of the 441 stainless steel coupons that were not cerium coated, especially in regions where gross separation of the scale from the metal substrate was observed. It is possible that cerium is being incorporated into the scale both by diffusion from the residual cerium oxide particles during oxidation testing and by infusion treatment.

This invention is shown by way of Example.

Example 1

Six coupons were cut from a Type 441 stainless steel (SS 441) sheet to a dimension of 25.4 mm×12.5 mm×thickness and numbered 1 through 6. A 3.175 mm diameter hole was drilled through each coupon. Coupons 1, 2 and 6 were polished with 600 grit paper. The weight of each coupon was recorded.

A cerium oxide composition was applied according to the invention to the surface of Coupons 1 and 3 and dried. Coupons 1, 2, 3 and 4 were heated at a temperature of 900° C. for 12 hours in a reducing atmosphere. From experience this was sufficient to infuse cerium into the coupon. The coupons were allowed to cool to room temperature. Coupons 1 and 3 were washed with water and lightly hand scrubbed to remove any remaining cerium oxide composition. The weight of the six coupons was recorded.

The results are reported in TABLE 3 and TABLE 4.

TABLE 3

Condition of SS 441 Coupons

| Coupon | Surface Condition | Cerium Coating | Infusion Thermal Cycle |
|---|---|---|---|
| 1 | Polished | Yes | Yes |
| 2 | Polished | No | Yes |
| 3 | Not Polished | Yes | Yes |
| 4 | Not Polished | No | Yes |
| 5 | Not Polished | No | No |
| 6 | Polished | No | No |

TABLE 4

Coupon Weights

| Coupon | Weight before thermal cycle | Weight after thermal cycle | Change in weight |
|---|---|---|---|
| 1 | 2.59319 gram | 2.59457 gram | 0.00138 gram |
| 2 | 2.65382 | 2.65345 | −0.00037 |
| 3 | 2.77604 | 2.77750 | 0.00146 |
| 4 | 2.77495 | 2.77357 | −0.00138 |
| 5 | — | — | — |
| 6 | — | — | — |

TABLE 4 shows that the coated coupons gained weight during cerium infusion. This weight gain was not attributed to cerium infusion alone and may also have been due to small amounts of residual cerium oxide coating. The weight loss in Coupons 2 and 4 was attributed to a loss of native oxide during heating in the reducing atmosphere. We noticed that Coupon 4 which was not polished lost more weight than Coupon 2 which was polished. We assumed that the unpolished coupon had a thicker native oxide coating and therefore lost more weight during heat treatment, or that more residual surface contamination was removed during heat treating.

Oxidation testing was carried out on the coupons by hanging them in a furnace on a quartz rack in an atmosphere of flowing, commercially dry air. The furnace temperature was cycled between room temperature and 800° C. for a total of 340 hours. After each cycle the coupons were weighed.

The scale that formed on the coupon surfaces were examined by Scanning Electron Microscopy (SEM). The coupons were embedded in epoxy and a cross-section cut with a slow speed diamond saw along the 25.4 mm length of the coupon. The sectioned surfaces were remounted in epoxy in a standard metallographic mount and polished using standard metallographic techniques. The cross-section was viewed with a Scanning Electron Microscope coupled with semi-quantitative (standard-less) Energy Dispersive X-ray (EDX) microanalysis. Therefore, chemical analysis was interpreted as qualitative and not quantitative.

FIG. 1*a* reports oxidation results for all sample conditions. Coupon 5 was not polished, was not cerium coated and was not thermally cycled, i.e. tested as received. Coupon 5 displayed the highest weight gain indicating the highest oxidation rate. Coupon 5 also showed weight loss with increasing exposure time indicating spalling.

Coupon 6 was polished, but was not cerium oxide coated and not thermally cycled. Coupon 6 displayed a significantly lower initial weight gain than Coupon 5. However, Coupon 6 had a larger weight gain than any of the cerium infused coupons or coupons subjected only to the cerium infusion thermal cycle. Testing of Coupon 6 was discontinued after 72 hours because the hanger broke.

FIG. 1*b* compares the oxidation results of Coupons 1, 2, 3 and 4. Coupon 1 was polished, cerium coated and thermally infused. Coupon 1 demonstrated the lowest weight gain of all the coupons. Coupon 3 was not polished, was cerium coated and thermally infused. Coupon 3 and Coupon 1 demonstrated similar weight gains.

Coupons 2 and 4 were not coated with cerium oxide paste. They were heated at 900° C. for 12 hours in reducing atmosphere. Coupons 2 and 4 were less oxidation resistant than the Ce infused Coupons 1 and 3. Higher weight gains indicate poorer oxidation resistance. Also, Coupon 2 lost weight after a few cycles, indicating oxide spalling, which does not produce a protective oxide scale. Comparing the oxidation curves of Coupons 1 and 3 to those of Coupons 2 and 4 clearly shows the improved oxidation resistance with the cerium infusion treatment.

After testing, a macrograph of the surface of each coupon was made. The macrographs showed that a uniform cerium oxide coating formed on both cerium infused samples (Coupon 1 and Coupon 3). The macrographs showed that all other coupons had a non-uniform oxide coating, showing degrees of oxide spalling.

A cross-section was made of the surface of Coupon 1, the polished and cerium infused coupon. The chemical composition of the phases was measured. Discrete cerium oxide particles were noted. The oxide scale was predominantly chromium with a significant amount of manganese, identified as the chromium-manganese spinel. Cerium was detected in the scale. However, essentially no cerium was detected in the base metal under the scale. A discrete titanium rich phase formed in the base metal under the oxide/metal interface. Niobium rich carbide resided along grain boundaries in the alloy.

A cross-section was made of the surface of Coupon 2 which was polished and thermal cycled without a cerium oxide coating. The chemical composition of the phases was measured. The macrograph showed that voids formed in the scale parallel to the oxide/metal interface. The voids resulted in spalling of the scale. The top surface of the oxide scale is more faceted than the scale that formed on Coupon 1, the cerium oxide coated coupon. Energy Dispersive X-ray (EDX) microanalysis showed that the oxide scale contained 10 wt % iron. Titanium rich and niobium rich phases formed in the base metal below the metal/oxide interface. The titanium and niobium phases probably oxidized when exposed to air, resulting in the voids observed at the interface.

A cross-section was made of the surface of Coupon 3, the unpolished, cerium oxide coated and thermal cycled coupon. The chemical composition of the phases was measured. Discrete, rather than continuous residual cerium oxide particles were identified on the top surface of the coupon. Energy Dispersive X-ray (EDX) microanalysis showed that cerium was incorporated into the scale. Most of the oxide scale was rich in chromium and manganese. Unlike Coupon 1, portions of this scale were separated from the base metal and a titanium rich phase was found in the scale. Titanium rich and niobium rich phases formed in the base metal adjacent the metal/oxide interface.

A cross-section was made of the surface of Coupon 4, the unpolished and thermal cycled coupon with no cerium oxide coating. The chemical composition of the phases was measured. Surface scale was non-uniform. Scale penetrated deeply into the base metal during sample exposure and selected phases at the interface were attacked. Portions of scale were detached from the surface. Where deep penetrations occurred, the oxide scale was almost entirely iron oxide. A chromium rich oxide layer formed underneath the iron rich oxides at the scale/metal interface. A large amount of iron was incorporated into the chromium rich scale away from the region of deep penetration where the scale separated from the base metal. Notably absent were titanium rich and niobium rich particles under the oxide scale. The adherent oxide comprised primarily chromium and manganese with relatively low iron content. Oxidation of titanium rich species was observed along grain boundaries in the base metal at the scale interface.

A cross-section was made of the surface of Coupon 5, the unpolished coupon without cerium oxide coating or heat treating. The chemical composition of the phases was measured. The coupon received only 72 hours of oxidation thermal cycling. There appeared to be a layering of the oxide scale in the regions where gross scale separation occurred. Transverse cracks were found in regions where a more compact scale was seen. Notably absent were titanium rich and niobium rich particles adjacent oxide scales.

The invention is an effective method of infusing cerium into type 441 stainless steel. The result is reduced oxidation of the stainless steel. The cerium oxide coated and heat treated coupons oxidized at a much lower rate and did not display any spalling. In comparison, the untreated coupons exhibited properties such as high weight gain and spalling.

After the infusion treatment, the residual cerium oxide particles were washed from the surface of the coupons before oxidation testing. Washing off the residual cerium oxide is not necessary to enhance oxidation resistance. Cerium promotes the formation of protective chrome oxides. The absence of cerium promotes the formation of less protective iron oxides.

Example 2

A cerium oxide paste was applied to nickel base alloys. Haynes® 230™ is a commercial nickel base alloy containing about 22 wt % chromium. Alloy J5 is a nickel base alloy containing about 12.5 wt % chromium. For comparison, we also tested Crofer 22APU (trade name), a ferritic stainless steel containing about 22% by weight chromium. Alloy compositions are recited in TABLE 2.

As in Example 1, two coupons of each alloy were cut to the dimensions 25.4 mm×12.5 mm×thickness. A 3.125 mm diameter hole was drilled through each coupon. The coupons were polished with 600-grit paper, cleaned and then weighed.

A cerium oxide composition was applied according to the invention to the surface of one coupon of each of the alloys and dried. These coupons, along with the uncoated, reference coupons were heated at a temperature of 900° C. for 12 hours under inert atmosphere. From experience this was sufficient treatment to infuse cerium into the coated coupons. The coupons were allowed to cool to room temperature. The coated coupons were washed with water and lightly scrubbed to remove any remaining cerium oxide composition. The coupons were weighed again.

The oxidation test of Example 1 was repeated. The coupons were suspended on a quartz rack in a furnace in an atmosphere of flowing, commercially dry air. Furnace temperature was cycled between room temperature and 800° C. for about 1800 hours. The coupons were weighed after each cycle.

All three cerium oxide treated alloy coupons demonstrated a lower specific mass change than the corresponding untreated coupon. This indicated a lower oxidation rate, shown in FIG. 2.

The higher chromium alloys, Haynes® 230™ and Crofer 22APU (trade name), showed an improvement of 25% to 30% in resistance to weight gain. The lower chrome alloy, Alloy J5 (trade name), demonstrated an improvement of about 300%. The improved oxidation resistance of treated Alloy J5 was comparable to that of the much higher chrome alloy, Haynes® 230™. Also, the cerium oxide infused Haynes® 230™ coupon showed an improvement in oxidation resistance. Haynes® $_{230}$™ is the most oxidation resistant alloy the inventors know of under these test conditions.

Example 3

SAVE 12 (trade name) is a low chrome stainless steel used for steam boiler tubes. The composition of SAVE 12 (trade name) is nominally 9.5 wt % chromium, 3 wt % tungsten, 3 wt % cobalt, 0.5 wt % manganese and iron as the balance. Test coupons were prepared and infused with cerium according to the invention as in Examples 1 and 2. Following thermal treatment, the coated coupons were washed and scrubbed to remove excess cerium oxide.

The oxidation test of Example 1 was repeated. The coupons were hung in a furnace on a quartz rack in an atmosphere of flowing air containing about 3% water. The moist air was made by passing commercially dry air though a water column at room temperature. Furnace temperature was cycled between room temperature and 800° C. for over 600 hours. After each cycle the coupons were weighed. Results are reported in FIG. 3.

The cerium infused SAVE 12 (trade name) coupon showed very little weight gain. The non-infused SAVE 12 (trade name) coupon showed rapid weight gain after about 100 hours. It is unlikely that this alloy would be selected for use under these conditions due to this rapid oxidation. However, it serves as an extreme example of the oxidation resistance provided by the cerium oxide treatment of the invention.

Example 4

HR 52, HR 53 and HR 54 are experimental stainless steels developed at the U.S. Department of Energy, Albany Research Center, Albany, Oreg. The compositions are disclosed in TABLE 1. Coupons were prepared from these alloys. One set of coupons was infused with cerium as disclosed in Example 1. The cerium infused coupons are referred to as HR52+Ce, HR53+Ce, and HR54+Ce As in Example 1, the coupons were hung in a furnace on a quartz rack in a flowing dry air atmosphere. The furnace temperature was cycled between room temperature and 650° C. for over 1100 hours. After each cycle the coupons were weighed. Results are reported in FIG. 4.

In FIG. 4, data for HR52+Ce, HR53+Ce, and HR54+Ce fall on top of each other. The cerium infused coupons showed a weight gain of only about 0.03 mg/cm$^2$. This was more than an order of magnitude less then the weight gain of 0.6 to 1.5 mg/cm$^2$ for coupons of the same alloys without cerium infusion.

We determined the composition of oxide phases that formed on the surface of the coupons by standard x-ray diffraction techniques. Compositions are reported in TABLE 5. Less protective iron-based oxides ($Fe_2O_3$, $Fe_3O_4$) formed on the surface of the non-cerium infused coupons. More protective chromium-based oxides formed on the cerium infused coupons. It appears that cerium suppresses the formation of the less protective iron oxides and promotes the formation of a more protective chromium oxide on the surface.

TABLE 5

OXIDE PHASES FORMED ON SURFACE OF ALLOYS AFTER EXPOSURE TO FLOWING DRY AT 650° C. FOR 1100 HOURS (DETERMINED BY X-RAY DIFFRACTION)

| Alloy | Oxide | Powder Diffraction File No. for oxide phase |
|---|---|---|
| HR 52 | Hematite ($Fe_2O_3$) | 33-0664 |
| | Iron-Chromium-Oxide $Fe_{1.2}Cr_{0.8}O_3$ | 34-0412 |
| | Chromium-Iron-Oxide $Cr_{1.3}Fe_{0.7}O_3$ | 35-1112 |
| | Chromite ($FeCr_2O_4$) | 34-0140 |
| HR 53 | Eskolaite ($Cr_2O_3$) | 38-1479 |
| | Chromium-Iron-Oxide $Cr_{1.3}Fe_{0.7}O_3$ | 35-1112 |
| | Chromite ($FeCr_2O_4$) | 34-0140 |
| | Hematite ($Fe_2O_3$) | 33-0664 |
| | Magnetite ($Fe^{2+}Fe^{3+}{}_2O_4$) | 19-0629 |
| HR 54 | Eskolaite ($Cr_2O_3$) | 38-1479 |
| | Iron-Chromium-Oxide $Fe_{1.2}Cr_{0.8}O_3$ | 34-0412 |
| | Chromium-Iron-Oxide $Cr_{1.3}Fe_{0.7}O_3$ | 35-1112 |
| | Magnetite ($Fe^{2+}Fe^{3+}{}_2O_4$) | 19-0629 |
| HR 52 + Ce | Eskolaite ($Cr_2O_3$) | 38-1479 |
| | Chromium-Iron-Oxide $Cr_{1.3}Fe_{0.7}O_3$ | 35-1112 |
| | Cerianite ($CeO_2$) | 43-1002 |
| HR 53 + Ce | Eskolaite ($Cr_2O_3$) | 38-1479 |
| | Chromium-Iron-Oxide $Cr_{1.3}Fe_{0.7}O_3$ | 35-1112 |
| | Cerianite ($CeO_2$) | 43-1002 |
| HR 54 + Ce | Eskolaite ($Cr_2O_3$) | 38-1479 |
| | Cerianite ($CeO_2$) | 43-1002 |

Example 5

Coupons of HR 52, HR 53, HR 54, HR52+Ce, HR53+Ce, and HR54+Ce were hung on a quartz rack in a furnace in an atmosphere of flowing moist air (3% moisture). Furnace temperature was cycled between room temperature and 650° C. for over 2000 hours. After each cycle the coupons were weighed. Results are reported in FIG. 5.

The test of the HR 52, HR 53, HR 54 coupons was terminated after 1100 hours because the non-cerium infused alloys oxidized so rapidly that longer testing time not needed.

In FIG. 5, data for HR52+Ce, HR53+Ce, and HR54+Ce fall on top of each other. The cerium-infused alloys displayed weight gains several order of magnitude lower than the non-cerium infused alloys. For example, the specific weight gain of HR 52 was 30 mg/cm$^2$ after 1100 hours exposure to moist air at 650° C., while the specific weight gain of HR52+Ce was 0.05 mg/cm$^2$ after 2000 hour exposure to moist air at 650° C.

We compared the results with Example 4 and noticed that the weight gains of non-cerium infused coupons increased by an order of magnitude in moist air. However, the weight gains of the cerium infused alloys were not affected by the moisture. Cerium infused alloy coupons displayed similar weight gains in both environments. This indicates that the Ce treatment is effective in protecting these low chromium steels in the aggressive environment of moist air.

Example 6

Alloy J12 and Alloy J13 are experimental low chromium, Ni alloys developed at the U.S. Department of Energy, Albany Research Center, Albany, Oreg. Compositions are reported in TABLE 1. Test coupons were prepared and infused with cerium as described in Example 1 according to the invention.

The oxidation test of Example 1 was repeated. The coupons were hung in a furnace on a quartz rack in an atmosphere of flowing moist air. The moist air was made by passing commercially dry air though a water column at room temperature to bring the water content to 3%. Furnace temperature was cycled between room temperature and 800° C. for over 1400 hours. After each cycle the coupons were weighed. Results are reported in FIG. 6.

The cerium infused alloy J12 demonstrated lower specific weight change than the corresponding non-cerium infused coupon. We noticed that Alloy J13 spalled. Spalling is weight loss due to the oxide scale falling off the surface. However, spalling on Alloy J13 discontinued after several cycles and the coupon gained weight similar to cerium infused Alloy J12. This example shows that the cerium infusion is effective in protecting low chromium nickel alloys.

The foregoing discussion discloses and describes embodiments of the present invention by way of example. One skilled in the art will readily recognize from this discussion and from the accompanying drawings and claims, that various changes, modifications and variations can be made therein without departing from the spirit and scope of the invention as defined in the following claims.

What is claimed is:

1. A method of diffusing cerium into chromia oxide forming substrates in a non-oxidizing environment to form a protective chromia scale comprising:

(a) preparing a cerium oxide paste, the cerium oxide paste comprised of cerium oxide and a halide activator, balance inert filler and inert transport fluid, wherein the cerium oxide is at least 10 wt % of the combined weight of the cerium oxide, halide activator, and inert filler, and wherein the halide activator is at least about 0.1 wt % of the combined weight of the cerium oxide and the halide activator;

(b) applying the cerium oxide paste over a surface of an alloy substrate comprised of at least 4 wt % chromium, forming a paste covered alloy substrate;

(c) heating the paste covered alloy substrate at a temperature of about 400° C. to about 1300° C. in a non-oxidizing atmosphere, for a period of time sufficient to diffuse cerium into the surface of the alloy substrate and produce a $CeCrO_3$ oxide scale on the surface of the alloy substrate;

(d) removing any remaining cerium oxide paste from the surface of the alloy substrate.

2. The method of claim 1 wherein the cerium oxide comprises at least 90 wt % of the cerium oxide, halide activator, and inert filler.

3. The method of claim 1 wherein heating is at a temperature of 700° C. to 1100° C.

4. The method of claim 1 wherein heating is at a temperature of 800° C. to 1000° C.

5. The method of claim 1 wherein heating is at a temperature of 700° C. to 1100° C. for a period of time of 1 hour to 100 hours.

6. The method of claim 1 wherein heating is at a temperature of 800° C. to 1000° C. for a period of time of 1 hour to 50 hours.

7. The method of claim 1 wherein the cerium oxide paste maintains a liquid consistency and the cerium oxide paste is applied to the surface of the alloy substrate by dipping, brushing, spraying, or combinations thereof.

8. The method of claim 1 wherein the halide activator is a mixture of fluoride and halide salts.

9. The method of claim 1 including: polishing the alloy substrate prior to applying the cerium oxide paste.

10. The method of claim 1 wherein the alloy substrate is an iron-base alloy comprising:

A major proportion of iron,
- 4 to 30 wt % chromium,
- 0 to 37 wt % nickel,
- 0 to 3 wt % silicon,
- 0 to 15.5 wt % manganese,
- 0 to 1.2 wt % carbon,
- 0 to 5 wt % of a metallic element elected from the group consisting of molybdenum, titanium, copper, aluminum, and niobium, and
- 0 to 1 wt % of a metallic element selected from the group consisting of yttrium and a rare earth element.

11. The method of claim 1, wherein the alloy substrate contains at least 0.1 wt % manganese, and wherein a chromium-manganese spinel forms over the $CeCrO_3$ type oxide scale on the surface of the alloy substrate.

12. The method of claim 1, wherein applying the cerium oxide paste includes coating the surface of the alloy substrate with the cerium oxide paste then drying the coated alloy substrate at a time and temperature sufficient to evaporate the inert transport fluid.

13. The method of claim 1, wherein the inert transport fluid comprises at least 30 wt % of the combined weight of the cerium oxide, halide activator, inert filler, and inert transport fluid.

14. The method of claim 1, wherein the alloy substrate contains silicon as an alloying element and the heating of the alloy substrate prevents silicon oxide formation in the $CeCrO_3$ oxide scale or internal oxidation of silicon in the alloy substrate.

15. The method of claim 1, wherein the cerium oxide paste consists of cerium oxide and a halide activator, balance inert filler and inert transport fluid, wherein the cerium oxide is at least 10 wt % of the combined weight of the cerium oxide, halide activator, and inert filler, and wherein the halide activator is at least about 0.1 wt % of the combined weight of the cerium oxide and the halide activator.

16. The method of claim 1 wherein the alloy substrate is an nickel-base alloy comprising:

A major proportion of nickel,
- 8 to 15 wt % chromium,
- 18 to 25 wt % molybdenum,
- 0.2 to 2 wt % titanium,
- 0.005 to 0.5 wt % aluminum,
- 0.1 to 1 wt % manganese,
- 0.01 to 0.5 wt % of a metallic element selected from the group consisting of yttrium and a rare earth element.

17. A method of applying a cerium diffusion coating on chromium oxide forming substrates to form a protective chromia scale comprising:

(a) preparing a cerium oxide paste, the cerium oxide paste comprised of cerium oxide and a halide activator, balance inert filler and inert transport fluid, wherein the cerium oxide is at least 10 wt % of the combined weight of the cerium oxide, halide activator, and inert filler, and wherein the halide activator is at least about 0.1 wt % of the combined weight of the cerium oxide and the halide activator, and wherein the inert transport fluid is at least 30 wt % of the combined weight of the cerium oxide, halide activator, inert filler, and inert transport fluid;

(b) applying the cerium oxide paste over a surface of an iron-base alloy to form a paste coated iron-base alloy, the iron-base alloy comprising:

A major proportion of iron,
- 4 to 30 wt % chromium,
- 0 to 37 wt % nickel,
- 0 to 3 wt % silicon,
- 0.1 to 15.5 wt % manganese,
- 0 to 1.2 wt % carbon,
- 0 to 5 wt % of a metallic element elected from the group consisting of molybdenum, titanium, copper, aluminum, and niobium, and
- 0 to 1 wt % of a metallic element selected from the group consisting of yttrium and a rare earth element.

(c) heating the paste covered iron-base alloy at a temperature of about 400° C. to about 1300° C. in a non-oxidizing atmosphere, for a period of time sufficient to diffuse cerium into the surface of the iron-base alloy and produce a $CeCrO_3$ oxide scale covered by a chromium-manganese spinel on the surface of the iron-base alloy;

(d) removing any remaining cerium oxide paste from the surface of the iron-base alloy.

18. The method of claim 17, wherein applying the cerium oxide paste includes coating the surface of the iron-based alloy with the cerium oxide paste then drying the coated iron-based alloy at a time and temperature sufficient to evaporate the inert transport fluid.

* * * * *